United States Patent [19]

Gheen et al.

[11] Patent Number: 4,487,400

[45] Date of Patent: Dec. 11, 1984

[54] COOLING PLATE

[75] Inventors: William E. Gheen, Center Valley; Millet L. Wei, Wescosville, both of Pa.

[73] Assignee: Bethlehem Steel Corporation, Bethlehem, Pa.

[21] Appl. No.: 517,046

[22] Filed: Jul. 27, 1983

Related U.S. Application Data

[63] Continuation of Ser. No. 343,065, Jan. 27, 1982, abandoned, which is a continuation of Ser. No. 166,711, Jul. 7, 1980.

[51] Int. Cl.[3] ..... F22B 37/00

[52] U.S. Cl. ..... 266/193; 122/6 A; 122/6 B; 138/38; 138/39; 138/42

[58] Field of Search ..... 266/190, 193, 194; 122/6 A, 6 B, 6 R, 406 A; 138/39, 36, 42; 406/139, 193

[56] References Cited

U.S. PATENT DOCUMENTS

| | | | |
|---|---|---|---|
| 579,406 | 3/1897 | Peters | 122/6 B |
| 717,248 | 12/1902 | McCausland | 122/6 B |
| 840,195 | 1/1907 | Berry | 122/6 R |
| 1,830,318 | 11/1931 | Harlan | 122/6 B |
| 2,590,797 | 3/1952 | Siciliano | 138/39 |
| 3,076,480 | 2/1963 | Vicard | 138/39 |
| 3,325,159 | 6/1967 | Loecher | 266/32 |
| 3,598,382 | 8/1971 | Ostrowski | 266/32 |
| 3,628,509 | 12/1971 | Becker | 266/193 |
| 4,029,053 | 6/1977 | Higuchi | 266/193 |

FOREIGN PATENT DOCUMENTS

| | | | |
|---|---|---|---|
| 305427 | 2/1929 | United Kingdom | 406/193 |

*Primary Examiner*—John Doll
*Assistant Examiner*—Robert L. Stoll
*Attorney, Agent, or Firm*—John J. Selko

[57] ABSTRACT

A cooling plate for insertion into the lining of a blast furnace or the like wherein the plate is adapted to have a chamber with cooling water channels for the passage of cooling water therethrough and having a unique baffle means for dividing the flow of water to increase the velocity of flow and avoid stagnant zones.

4 Claims, 6 Drawing Figures

COOLING PLATE

This is a continuation of application Ser. No. 343,065, filed 1/27/82, now abandoned, which is a continuation of application Ser. No. 116,711, filed 7/7/80.

BACKGROUND OF THE INVENTION

The present invention relates to metallurgical apparatus and more particularly to cooling plates for insertion into the refractory lining of a blast furnace or the like.

Cooling systems are provided for the furnace walls of shaft furnaces as e.g. blast furnaces to effectively cool the walls subjected to high temperature conditions. The cooling systems comprise a plurality of cooling plates inserted in a pattern developed to adequately cool the furnace walls so that failure or breakout is prevented.

The cooling plates with circulating water are used in the bosh, belly and stack sections of a blast furnace to cool the refractory lining in order to stabilize and extend the life of refractories. The plates are generally inserted horizontally and imbedded in the refractory lining at desired spacing both in circumferential and vertical directions. The cooling plates are usually made of copper castings with essentially pure copper for high thermal conductivity.

The cooling plates are subject to failure by burnout or cracking due to two main factors. One factor is insufficient water flow, resulting in insufficient heat transfer. The other and more important factor is the existence of stagnant zones inside the cooling plates, such as dead pockets, eddies or vortices. The stagnation of water causes film boiling on the surface of the copper plate, leading to melting and burnout. The failures not only necessitate purchase of a large quantity of expensive replacement plates, but also cause the shutdown of the furnace and consequent loss of production from that unit.

Many designs of cooling plates have been made to overcome the deficiencies noted above but the search continues for a more effective design.

SUMMARY OF THE INVENTION

It is, therefore, an object of this invention to provide a cooling plate possessing unique design features that overcome the above-mentioned deficiencies.

It is a further object of the invention to provide a cooling plate having extended service life.

It is yet another object of the invention to provide a cooling plate that is economicaal and easy to manufacture.

The present invention accomplishes these objects by providing a cooling plate having a plurality of cooling water channels for the circulation of cooling water therethrough. The flow of the cooling water through the cooling water channels is directed from a tail flange around a nose section and back to the tail flange. Means which include a horseshoe baffle plate to divide the flow of water are provided to direct the cooling water smoothly around the nose section.

Other objects and advantages of the invention will appear from the following detailed description which, considered with the accompanying drawings, disclose preferred embodiments of the invention for purposes of illustration only. For definition of the scope of the invention, reference will be made to the appended claims.

DESCRIPTION OF THE PREFERRED EMBODIMENT

Figures 1, 2, 4, 5:
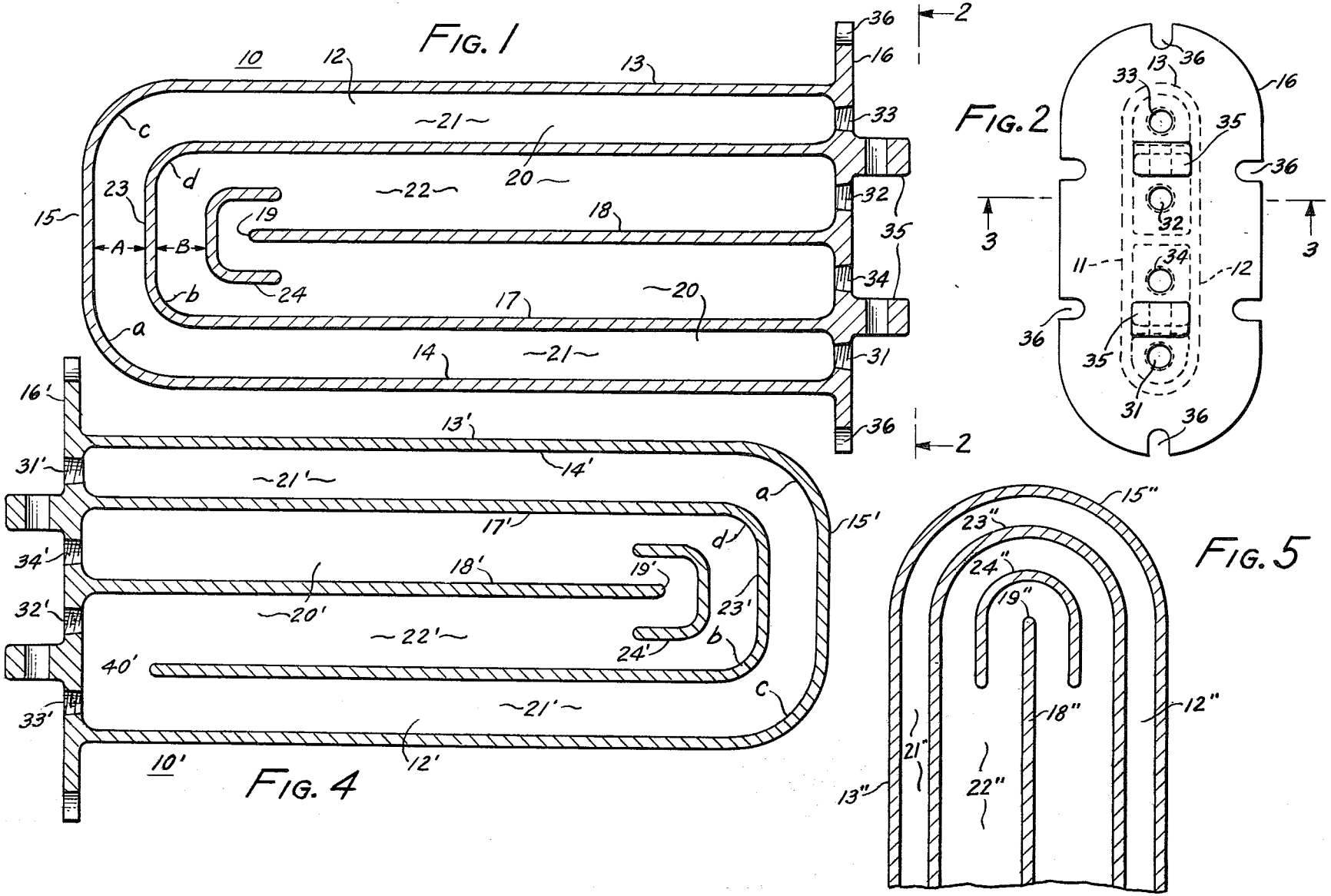
FIG. 1 is a longitudinal section taken through one embodiment of the cooling plate of the instant invention.
FIG. 2 is an end view of the cooling plate taken on line 2—2 of FIG. 1.
FIG. 4 is a view similar to FIG. 1 showing an alternate embodiment of the invention.
FIG. 5 is a fragmentary portion of the longitudinal section take through a cooling plate of another embodiment of the invention.
Figure 3:
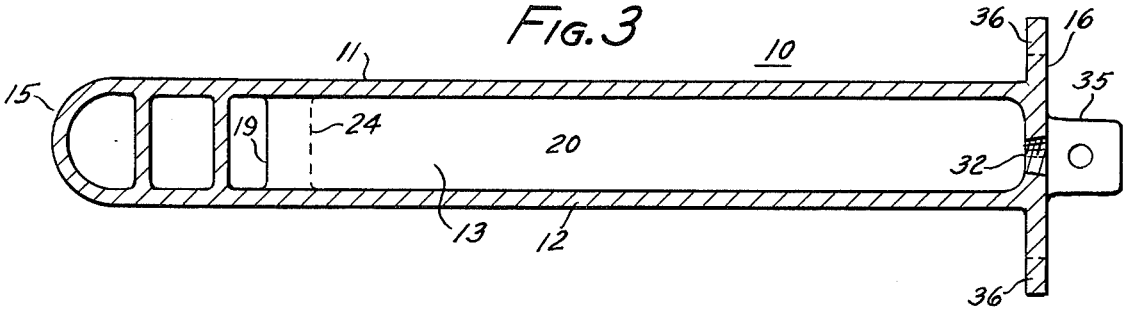
FIG. 3 is a section taken on line 3—3 of FIG. 2.

Referring to the FIGS. 1–3 inclusive there is shown a cooling plate 10 having a generally flat spade-like configuration which is cast in copper and defines a closed interior chamber 20 for the passage of cooling water therethrough. Top surface 11 and bottom surface 12 are connected in spaced relation by sidewall 13 which has an inner side 14. Sidewall 13 starts at tail flange 16, extends around nose section 15 in a loop and returns to tail flange 16 to form closed chamber 20 for the passage of cooling water.

A first partition wall 17 is spaced from the inner side 14 of sidewall 13 starting at tail flange 16 extending around the nose section 15 and terminating at the end flange 16 to form a first cooling water channel 21 for the passage of cooling water. A second partition wall 18 inside first partition wall 17 extends outwardly from the tail flange 16 toward the nose section 15 having a terminus 19 spaced from the nose section of first partition wall 17 and forming a second cooling water channel 22. Located between the terminus 19 of partition wall 18 and nose section or loop 23 of partition wall 17 is a horseshoe-shaped baffle 24 with the open end of the horseshoe extending toward the tail flange 16 for a distance of at least one-half the width of the water channel as shown in FIG. 1 and specifically dimensioned in the Specific Example hereinafter set forth. The horseshoe-shaped baffle 24 is located substantially on the centerline of the water channel as seen in FIG. 1 divides the flow of cooling water in the second cooling water channel 22 around the nose section or loop 23 to increase the velocity of flow of the cooling water and concurrently avoids stagnant zones in the loop area. Large radii "a", "b", "c" and "d" are provided at the loop area to assure the smooth flow of cooling water around the loops to facilitate the flow of cooling water through the water channels while avoiding stagnant zones.

Cooling plate 10 is provided with four openings in the tail flange 16 for water inlet/outlet connections. The inlet/outlet openings are also used as core sand removing holes.

Lugs 35 are provided on tail flange 16 for handling the cooling plates for installation and removal. Bolt slots 36 are provided in the tail flange 16 for bolting the cooling plates 10 to the metal shell of the furnace.

The embodiment of the invention shown in FIG. 1 is a double chamber cooling plate wherein cooling water is injected at first and second cooling water inlets 31 and 32 into cooling water channels 21 and 22 respectively and discharged through first and second outlets 33 and 34 respectively. First cooling water inlet 31 and first cooling water outlet 33 are aligned with first cooling water channel 21. Second cooling water inlet 32 and second cooling water outlet 34 are aligned with cooling water channel 22.

Referring now particularly to FIG. 4, an alternate embodiment of the invention is shown in which the cooling plate is a single chamber cooling plate, i.e. the cooling water is introduced at cooling water inlet of first opening 31' aligned with first cooling water channel 21', follows a circuitous flow through cooling water channels 21' and 22' to cooling water outlet or second opening 34' aligned with second cooling water channel 22', the water passing through the entire interior chamber before being discharged at opening 34'. Plugs are placed in openings 32' and 33' to close the openings in this single chamber cooling plate.

The alternate embodiment shown in FIG. 4 is similar in construction to the embodiment of FIG. 1 except for details to be described. The cooling plate 10' comprises a top surface (not shown) similar in all respects to top surface 11 connected to bottom surface 12' by sidewall 13' having an inner side 14', first partition wall 17' and second partition wall 18'. A first cooling water channel 21' is defined by the space between inner side 14' and first partition wall 17'. The second cooling water channel 22' is defined by the space between first partition 17' and second partition wall 18' and one end of first water channel 21' is in communication with one end of second water channel 22' at opening 40'. Opening 40' is created by the termination of first partition wall 17' spaced from end flange 16'. As seen in the embodiment shown in FIG. 1, a horseshoe baffle 24' having legs extending toward the tail flange for a distance of at least one-half the width of the water channel and as specifcally dimensioned in the Specific Example hereinafter set forth is located similarly substantially on the centerline of the water channel as seen in FIG. 4 to divide the flow of cooling water in the second cooling water channel 22' to increase the velocity of flow thereof and to avoid stagnant zones.

It should be noted that the construction of the nose sections 15 and 15' of cooling plates 10 and 10' respectively as shown display a straight portion between the two curved portions and that it may be advantageous or preferable in some cases to provide the nose sections 15 and 15' as a semicircular curve to aid in the smooth flow of the cooling water therearound. FIG. 5 shows an alternate embodiment of the invention wherein the nose section 15" comprises semicircular curves for the loop portions of sidewall 13", partition 23" and horseshoe 24" located in the water channel on the centerline thereof and having legs extending toward the tail flange for a distance of at least one-half the width of the water channel.

Figure 6:
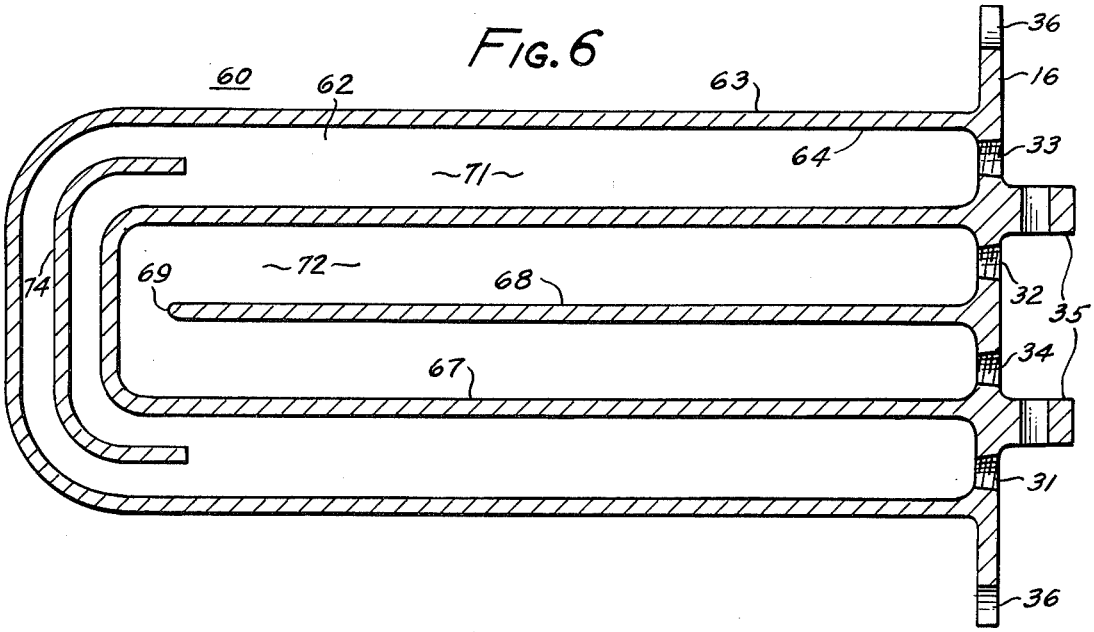
FIG. 6 is a view similar to FIG. 1 showing yet another embodiment.

The alternate embodiment shown in FIG. 6 is similar in construction to the embodiment of FIG. 1 except for details to be described. The cooling plate 60 comprises a top surface (not shown) similar in all respects to top surface 11 connected to bottom surface 62 by sidewall 63 having an inner side 64, first partition wall 67 and second partition wall 68. A first cooling water channel 71 is defined by the space between inner side 64 and first partition wall 67. The second cooling water channel 72 is defined by the space between first partition 67 and second partition wall 68. In contrast to the embodiment shown in FIG. 1, a horseshoe baffle 74 is located between sidewall 63 and first partition wall 67 substantially on the centerline and having legs extending toward the tail flange for a distance of at least one-half the width of the water channel to divide the flow of cooling water in the first cooling water channel 71 to increase the velocity of flow thereof and to avoid stagnant zones.

SPECIFIC EXAMPLE

The following description of a specific example relates to the embodiment shown in FIG. 1 and shows a cooling plate for insertion in the lining of a blast furnace cast from essentially pure copper, tested with 125# steam pressure. The outside dimensions of the cooling plate include 40 inch length overall, 14 inch width and $4\frac{3}{4}$ inches depth. Cooling water channel 21 measures approximately $1\frac{1}{4}$ inches wide by $3\frac{5}{8}$ inches depth, sidewall 13 being rounded as is clear from FIG. 3. The partition walls 17 and 18 are 7/16 inch thick and cooling water channel 22 measures $3\frac{1}{2}$ inches wide by $3\frac{5}{8}$ inches deep. A horseshoe-shaped baffle 24 is inserted in second cooling water channel 22 substantially on the centerline and having legs extending toward the tail flange for a distance of at least one-half the width of the water channel to divide the stream of cooling water to overcome stagnant zones by virtue of the resulting configuration and the improved water velocity. The baffle 24 is 7/16 inch thick and has an opening of $3\frac{1}{2}$ inches. The legs of the horseshoe extend along the partition wall 18 for about 2 inches from the terminus 19.

The radii "a", "b", "c", "d" are designed to be maximum, e.g. a and c=5 inches; b and d=2-9/32 inches, to provide a smooth channel for the passage of the cooling water therearound.

The water flow is generally maintained at 35 gpm. The cross sectional area of the cooling water channel 21 at location A is 3.08 $in^2$ and the velocity is 3.65 ft/sec. At location B in cooling water channel 22 having horseshoe-shaped baffle 24 therein the area is 4.33 $in^2$ and the velocity of flow of the cooling water is 2.59 ft./sec.

It will be clear to those skilled in the art that similar area and velocity results can be easily determined for the alternate embodiments of FIGS. 4, 5 and 6.

The invention described hereinabove provides users of water cooled furnace cooling plates with a new and improved design of cooling plates to overcome stagnant zones in the water chamber such as dead pockets, eddies and/or vortices. These stagnant zones are responsible for burnouts in existing plates. The improved water velocity resulting from the design of the invention improves heat transfer and extends service life.

The design of this invention maintains low pressure drop within the cooling plates by streamlining the water passageways, avoiding sharp curves and bends and providing gradual acceleration and deceleration of water flow both in the straight and curved sections.

While preferred embodiments of the invention have been illustrated and described it should be understood that the invention is not to be limited to the precise details set forth but that changes and alterations as fall within the purview of the claims are to be included.

We claim:

1. A cooling plate for insertion in the lining of a furnace, comprising a top surface and a bottom surface, a sidewall having an inner side and connecting said top and bottom surfaces in spaced relation and extending in a loop around a nose section at one end of said cooling plate; a tail flange having openings for the passage of cooling water therethrough enclosing the other end of said cooling plate to form a closed chamber within said cooling plate; a first partition wall spaced from said inner side of said sidewall and forming with said sidewall a first cooling water channel, said first partition wall starting adjacent said tail flange forming a loop around said nose section; a second partition wall inside said first partition wall extending outwardly from said tail flange toward said nose section and having a terminus spaced from said first partition wall forming a second cooling water channel; a horseshoe-shaped baffle provided in at least one of said first and second cooling water channels comprising a single, substantially continuous U-shaped portion located in said cooling water channel at the nose section thereof with leg portions extending parallel to said second partition wall and from said U-shaped portion toward said tail flange for a distance of at least about two inches, said baffle, at a cooling water flow rate of 35 gpm, increasing the velocity of flow of cooling water to 2.59 ft./sec. in the cooling water channel wherein said baffle is provided, when the flow rate is 3.65 ft./sec. in the cooling water channel wherein said baffle is not provided, whereby stagnant zones are avoided.

2. The cooling plate according to claim 1 wherein said horseshoe-shaped baffle is located in said first cooling water channel.

3. The cooling plate according to claim 1 wherein said horseshoe-shaped baffle is located in said second cooling water channel.

4. The cooling plate according to claim 1 wherein the nose section is a semi-circular curve.

* * * * *